US012577945B2

(12) United States Patent
Grayson et al.

(10) Patent No.: US 12,577,945 B2
(45) Date of Patent: Mar. 17, 2026

(54) PUMP FOR TWO-PHASE MAGNETIC FLUIDS

(71) Applicant: Blue Origin Manufacturing, LLC, Huntsville, AL (US)

(72) Inventors: Gary D. Grayson, Maple Valley, WA (US); Zachary Daniel Rizzolo, Renton, WA (US); Emmanuel John Grillos, II, Kent, WA (US); Michael Friedman, Belton, TX (US)

(73) Assignee: Blue Origin Manufacturing, LLC, Huntsville, AL (US)

( * ) Notice: Subject to any disclaimer, the term of this patent is extended or adjusted under 35 U.S.C. 154(b) by 233 days.

(21) Appl. No.: 18/322,262

(22) Filed: May 23, 2023

(65) Prior Publication Data

US 2024/0392765 A1 Nov. 28, 2024

(51) Int. Cl.
*F04B 17/00* (2006.01)
*F04B 15/00* (2006.01)

(52) U.S. Cl.
CPC ..... *F04B 17/00* (2013.01); *F04B 15/00* (2013.01)

(58) Field of Classification Search
CPC ..... F04B 17/00; F04B 15/00; F04B 19/006; H02K 44/06
USPC ..... 417/50, 48; 310/11
See application file for complete search history.

(56) References Cited

U.S. PATENT DOCUMENTS 2,655,107 A * 10/1953 Godbold ..... H02K 44/04 310/11
2,764,095 A * 9/1956 Baker ..... H02K 44/06 310/11
2,811,923 A * 11/1957 Barnes ..... H02K 44/04 310/11
2,905,089 A * 9/1959 Blake ..... H02K 44/04 310/11
2,988,997 A * 6/1961 Elrod, Jr. ..... H02K 44/04 310/11
3,005,116 A * 10/1961 Reece ..... H02K 41/025 310/11
3,198,119 A * 8/1965 Mead ..... H02K 44/04 310/11

(Continued)

OTHER PUBLICATIONS

Edwin Ethridge, Ph.D., "Using Microwaves for Extracting Water from the Moon," COMSOL Conference, Boston, MA, Oct. 9, 2009.

(Continued)

*Primary Examiner* — Mark A Laurenzi
*Assistant Examiner* — Benjamin Doyle
(74) *Attorney, Agent, or Firm* — Summit Patents PC

(57) ABSTRACT

Architectures and methods of operation for a pump for pumping two-phase magnetic fluids are described. The pump is capable of such pumping and may operate with no moving parts. Instead, the pump operates by selectively activating and deactivating each of a series of electrical circuits to control the presence or absence of magnetic fields applied to the two-phase magnetic fluid. The two-phase magnetic fluid may include liquid phase and gas phase, which may be in the form of bubbles. Though a presence of bubbles in a liquid may lead to cavitation and failure in some pumps, pumps for pumping two-phase magnetic fluids can avoid such a failure mechanism, in addition to avoiding another failure mechanism of wear and tear on moving parts.

20 Claims, 5 Drawing Sheets

(56) References Cited

U.S. PATENT DOCUMENTS 3,257,949 A * 6/1966 Mead ..... H02K 44/04 310/11
3,260,209 A * 7/1966 Rhudy ..... H02K 44/06 310/11
3,302,573 A * 2/1967 Ledeen ..... H02K 44/06 310/11
3,584,976 A * 6/1971 Schuster ..... H02K 44/00 417/50
3,585,422 A * 6/1971 Burnier ..... H02K 31/04 310/11
3,656,867 A * 4/1972 Carbonnel ..... H02K 44/06 310/11
3,885,890 A * 5/1975 Davidson ..... H02K 44/06 417/50
3,906,415 A * 9/1975 Baker ..... H01H 29/00 335/49
4,366,857 A * 1/1983 Mayer ..... F28D 15/0266 505/901
4,392,786 A * 7/1983 Merenkov ..... H02K 44/02 417/50
4,565,748 A * 1/1986 Dahl ..... F04D 33/00 204/DIG. 5
4,707,676 A * 11/1987 Saitou ..... G01R 33/3815 335/216
4,808,079 A * 2/1989 Crowley ..... F04B 17/00 310/11
4,828,459 A * 5/1989 Behrens ..... G21C 15/247 106/DIG. 3
5,026,681 A * 6/1991 Hed ..... H02K 44/02 505/165
5,240,382 A * 8/1993 Bessho ..... H02K 44/06 310/11
5,415,529 A * 5/1995 Le Boucher ..... H02K 44/26 310/11
5,685,698 A * 11/1997 Smoll ..... B63H 11/025 623/3.1
5,901,557 A 5/1999 Grayson
6,318,970 B1 * 11/2001 Backhouse ..... H02K 44/02 417/92
6,591,867 B2 7/2003 Grayson
6,840,275 B2 1/2005 Grayson
8,480,377 B2 * 7/2013 Ciocanel ..... H02K 41/03 204/600
8,506,468 B2 * 8/2013 Ghiron ..... A61N 2/006 600/13
8,524,506 B2 * 9/2013 Pamula ..... G02B 26/005 422/50
8,764,410 B2 * 7/2014 Proepper ..... F28F 13/16 417/50
9,151,520 B2 * 10/2015 Despesse ..... F25B 30/02
9,341,023 B2 * 5/2016 Defretin ..... F04B 17/042
2003/0235504 A1 * 12/2003 Lemoff ..... H02K 44/04 417/50
2004/0219026 A1 * 11/2004 Peysakhovich ..... F04B 17/04 417/53
2006/0110260 A1 * 5/2006 Hsu ..... H02K 44/08 417/48
2008/0118370 A1 * 5/2008 Zoulkarneev ..... H02N 11/006 137/807
2008/0314749 A1 * 12/2008 Johnson ..... G01N 33/54326 204/600
2010/0085137 A1 * 4/2010 Baker ..... H01F 6/06 335/216
2010/0263454 A1 * 10/2010 Araseki ..... G01F 1/582 73/861.11
2011/0031861 A1 * 2/2011 Gentry ..... F25J 3/04945 29/890.035
2011/0192573 A1 * 8/2011 Defretin ..... F04B 17/042 137/154
2015/0352561 A1 * 12/2015 Holland ..... C02F 1/487 210/695
2019/0024655 A1 * 1/2019 Donaldson ..... F04B 15/00
2020/0049150 A1 * 2/2020 Yoshimoto ..... F04D 13/08

OTHER PUBLICATIONS

Eric E. Rice, "Development of Lunar Ice/Hydrogen Recovery System Architecture," Universities Space Research Association (USRA), Jan. 1, 2000.

Robert Youngquist, John Lane, Christopher Immer, and James Simpson, "Pumping Liquid Oxygen by Use of Pulsed Magnetic Fields," NASA Tech Briefs, John F. Kennedy Space Center, Florida, Feb. 2004.

Romero-Calvo, Á., Akay, Ö., Schaub, H. et al. Magnetic phase separation in microgravity. npj Microgravity 8, 32 (2022). https://doi.org/10.1038/s41526-022-00212-9.

Stephen Hoffman et al., "Mining" Water Ice on Mars An Assessment of ISRU Options in Support of Future Human Missions, Jul. 2016.

Steve Roy, Marshall Space Flight Center News Releases, "Cooking Up Water From the Moon? NASA Studies Water Extraction With Microwaves" Oct. 19, 2009, https://www.nasa.gov/centers/marshall/news/news/releases/2009/09-083.html.

Tanya Lewis, "Incredible Technology: How to Mine Water on Mars," Incredible Technology, Dec. 23, 2013, https://www.space.com/24052-incredible-tech-mining-mars-water.html.

* cited by examiner

PUMP FOR TWO-PHASE MAGNETIC FLUIDS

BACKGROUND

Pumps are used in numerous applications. Generally, pumps may be designed to pump either gas or liquids. An important aspect of pumps is that they are inherently constructed of moving parts, which can wear out or age over time. For example, pumps have life-limiting features arising from parts of which they're comprised, such as shaft seals, impellers, bearings, and piston rings.

BRIEF DESCRIPTION OF THE DRAWINGS

The disclosure will be understood more fully from the detailed description given below and from the accompanying figures of embodiments of the disclosure. The figures are used to provide knowledge and understanding of embodiments of the disclosure and do not limit the scope of the disclosure to these specific embodiments. Furthermore, the figures are not necessarily drawn to scale.

DETAILED DESCRIPTION

Figure 1:
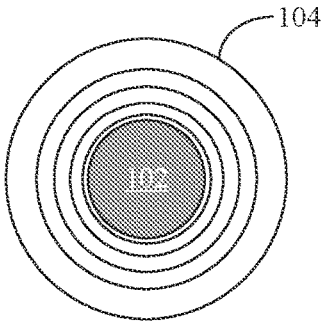
FIG. 1 illustrates an unshielded electrical conductor and magnetic flux, according to some embodiments.

This disclosure describes architectures and methods of operation for a pump for pumping two-phase magnetic fluids. In particular, the pump is capable of such pumping and may operate with no moving parts. Instead, the pump operates by selectively activating and deactivating each of a series of electrical circuits to control the presence or absence of magnetic fields applied to the two-phase magnetic fluid.

A two-phase magnetic fluid may include liquid phase and gas phase, which may be in the form of bubbles (e.g., a cavity of gaseous vapor within the liquid phase) or in other two-phase flow regimes, such as stratified flow, annular flow, slug flow, and slug bubbly flow. A presence of bubbles or other forms of gas phase in a liquid may generally lead to cavitation in a pump, particularly in centrifugal pumps where the bubbles may develop or accumulate around the impeller's axis. Thus, a failure mechanism of liquid pumps, in addition to wear and tear on moving parts, is the presence of a gas phase leading to pump cavitation. The pump for pumping two-phase magnetic fluids, as described herein, need not rely on a net positive suction pressure, unlike mechanical pumps that have to avoid cavitation at inducers or impellers by providing such a net positive suction pressure.

Situations that involve pumping two-phase fluids may arise in numerous applications, but applications in low-gravity conditions are particularly important for space flight. For example, rocket engines may use cryogenic propellants including liquid hydrogen and liquid oxygen. Due to the low-temperatures of these propellants, heat may continuously be transferred through walls of the storage vessels of the propellants, such as during a space vehicle's orbit. This heat transfer may cause the liquid propellants to boil, thus creating a gas phase. Another situation that arises in low-gravity conditions involves the acquisition of a single, liquid phase fluid from the storage vessels upon demand for use by the space vehicle. On Earth, where gravity is significant, liquid is generally in a known location within the vessel, settled against the vessel's bottom with the gas phase above. In a reduced-gravity environment, however, the absence of a significant gravitational force generally leads to the liquid and gas phases being free to move about inside the vessel. Thus, fluid acquisition from the vessel may include gas phase with the intended liquid phase. When the fluid acquired from the vessel is subsequently pumped to its destination, a two-phase magnetic fluid pump, described herein, is capable of performing the pumping operations, at least for a magnetic fluid such as paramagnetic liquid oxygen, even with the inclusion of a gas phase.

Herein, pumping refers to the action of conveying (e.g., moving, transferring, causing to flow) a fluid from one location to another location by providing a force to act on the fluid. For example, pumping may involve moving the fluid through a tube or pipe to transfer the fluid a substantial distance. Generally, fluid on an input side of a pump may have a lower pressure than fluid on an output side of the pump, which creates such a pressure differential.

The fluid may be a liquid in a pure liquid phase, or a liquid that is partly in a gas phase (e.g., contains bubbles). The fluid, at least at operating temperatures of the pump, may be paramagnetic, diamagnetic, or ferromagnetic (e.g., liquids with colloidally suspended magnetic particles). In some implementations, the fluid is cryogenic, such as liquid oxygen, which is paramagnetic and is used in rocket propulsion systems. In various embodiments, the (e.g., bulk) fluid may comprise two or more different fluids, such as liquid (which may include gas phase) helium, nitrogen, or neon, with liquid oxygen being present in the pump.

In some embodiments, a pump for conveying a two-phase magnetic fluid comprises electromagnets configured to be sequentially energized to produce an asymmetric magnetic field in the two-phase magnetic fluid to create a force imbalance on the two-phase magnetic fluid so as to convey the fluid in a general direction. The electromagnets may be superconducting electromagnets. For example, the electromagnets may comprise electrical conductors that behave as superconductors under particular thermal conditions. The pump may also comprise a vessel, such as a tube, pipe, or conduit for conveying the two-phase magnetic fluid. An input port of the vessel may be where the two-phase magnetic fluid enters the vessel, and an output port may be where the two-phase magnetic fluid exits the vessel. For example, the input port of the vessel may be the entrance of a pipe. The pump may include electronics to sequentially energize the electromagnets. Such sequential energizing is described below.

In some implementations, the electromagnets may be located where they are subjected to cryogenic temperatures of the two-phase magnetic fluid flowing in the vessel (e.g., pipe). For example, thermal conductivity of the wall of the vessel may allow for "coldness" of a cryogenic fluid in the vessel to transfer to the superconducting electromagnets and cool them to a temperature where they can behave as superconductors. In other words, the electromagnets may be configured and/or positioned to be cooled by the two-phase magnetic fluid.

In some embodiments, the electronics may be configured to vary the frequency or time period during which the electromagnets are sequentially energized based, at least in part, on flow speed of the two-phase magnetic fluid. For example, individual electromagnets among a series of electromagnets may be individually energized at different times (in sequence) to create a magnetic field for a particular time span, which may be varied. Fluid flow speed may correspond to this particular time span. In this way, fluid flow speed may be adjusted by varying the time span during which each of the electromagnets are energized. One or more sensors may be included in a pump to measure speed, volume, and/or type of flow (e.g., laminar or turbulent), for example, of the fluid flow in the pump vessel.

In some embodiments, the electronics may be configured to reverse the sequence of energizing the electromagnets to stop or reverse direction of flow of the two-phase magnetic fluid. For example, if the electromagnets are sequentially energized in a particular order (e.g., 1, 2, 3, . . . ) to pump fluid in a particular direction, then reversing the particular order (e.g., . . . , 3, 2, 1) may result in the pump reversing the flow direction. This principle of operation may be useful for relatively quickly slowing or stopping fluid flow (with or without the assistance of valves, for example, in other parts of the fluid system).

In some embodiments, a pump for conveying a two-phase magnetic fluid may comprise a vessel for conveying the two-phase magnetic fluid, a first electromagnet, and a second electromagnet. Generally, a pump may have more than two electromagnets, but these embodiments are useful for demonstrating principles of operation of some of the pumps described herein. The first electromagnet is located closer than the second electromagnet to an input port of the vessel, and the second electromagnet is located closer than the first electromagnet to the output port. The pump may further comprise electronics to energize the first electromagnet and the second electromagnet sequentially such that i) the energized first electromagnet applies a force on the two-phase magnetic fluid to convey the two-phase magnetic fluid from the input port of the vessel and toward the second electromagnet, and ii) the energized second electromagnet applies a force on the two-phase magnetic fluid to convey the two-phase magnetic fluid from the first electromagnet and toward the output port of the vessel.

In some implementations, the first electromagnet and the second electromagnet are located outside of the vessel and along a perimeter of the vessel. The first electromagnet and the second electromagnet may be located in a region that is subjected to cryogenic temperatures of the two-phase magnetic fluid via a thermally conducting wall of the vessel. If the first and second electromagnets comprise superconducting conductors, then the cold cryogenic temperatures may support superconductive behavior of these conductors.

In some embodiments, the first electromagnet and the second electromagnet comprise shielding to at least partially block (e.g., redirect) magnetic flux produced by the first electromagnet and the second electromagnet. The shielding creates asymmetry in the magnetic flux, which is used to convey the two-phase magnetic fluid, as described below.

FIG. 1 illustrates a cross-section of an electrical conductor 102 (e.g., a wire) and lines of magnetic flux 104, according to some embodiments. The density of the magnetic flux lines represents the strength of the magnetic field. For example, closely spaced flux lines represent a strong magnetic field and widely spaced flux lines represent a weaker magnetic field. An electric current in the conductor creates the magnetic flux. Magnetic flux 104 has a counterclockwise orientation if the electric current in conductor 102 is directed out of the drawing, and the magnetic flux will have a clockwise orientation if the electric current in conductor 102 is directed into the drawing. The direction of a force on an electric or magnetic dipole, or paramagnetic or diamagnetic fluids, may depend on the orientation of the magnetic flux.

Figure 2:
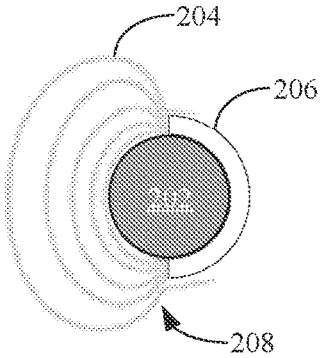
FIG. 2 illustrates a partially shielded electrical conductor and magnetic flux, according to some embodiments.

FIG. 2 illustrates a cross-section of an electrical conductor 202 (e.g., a wire) and lines of magnetic flux 204, according to some embodiments. The electrical conductor is the same as that in FIG. 1, and the magnetic flux would also be the same except for the inclusion of a magnetic flux shield 206 (hereinafter "shield"). Magnetic flux 204 is shaped by shield 206, which at least partially blocks (e.g., by redirecting) flux lines on the right side of electrical conductor 202. Shield 206 may be a ferromagnetic metal containing iron, nickel, or cobalt, for example. Shield 206 may be a semispherical shell that covers about half of conductor 202. The shield reshapes the magnetic field and thus reshapes the lines of magnetic flux 204, which are asymmetric about the center point of the conductor, in contrast to the symmetry of flux 104. Such reshaping by magnetic shielding (e.g., or by redirecting) may produce regions 208 that have a magnetic field that is stronger compared to a magnetic field in those regions with no reshaping. As mentioned above, the density of the magnetic flux lines represents the strength of the magnetic field.

Figure 3:
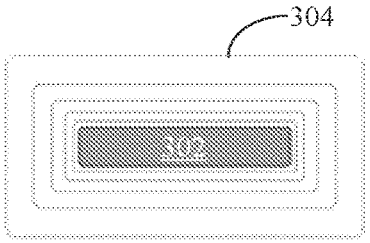
FIG. 3 illustrates an unshielded non-circular electrical conductor and magnetic flux, according to some embodiments.

FIG. 3 illustrates an unshielded non-circular electrical conductor 302 and magnetic flux 304, according to some embodiments. The density of the magnetic flux lines represents the strength of the magnetic field, as explained above. An electric current in the conductor creates the magnetic flux, which generally conforms to the shape of the conductor. Magnetic flux 304 has a counterclockwise orientation if the electric current in conductor 302 is directed out of the drawing, and the magnetic flux will have a clockwise orientation if the electric current in conductor 302 is directed into the drawing. The direction of a force on an electric or magnetic dipole, or paramagnetic or diamagnetic fluids, may depend on the orientation of the magnetic flux.

Figure 4:
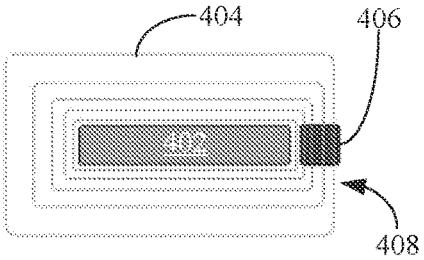
FIG. 4 illustrates a partially shielded non-circular electrical conductor and magnetic flux, according to some embodiments.

FIG. 4 illustrates a partially shielded non-circular electrical conductor 402 and magnetic flux 404, according to some embodiments. The electrical conductor is the same as that in FIG. 3, and the magnetic flux would also be the same except for the inclusion of a magnetic flux shield 406 (hereinafter "shield"). Magnetic flux 404 is shaped by shield 406, which affects the flux lines on the right side of electrical conductor 402. Shield 406 may be a ferromagnetic metal containing iron, nickel, or cobalt, for example. Shield 406 may be an elongated strip, having a rectangular cross-section, arranged parallel to conductor 402. The shield reshapes the magnetic field and thus reshapes the lines of magnetic flux 404, which are asymmetric about the center point of the conductor, in contrast to the symmetry of flux 404. Such reshaping by magnetic shielding may produce regions 408 that have a magnetic field that is stronger compared to a magnetic field in those regions with no reshaping. As mentioned above, the density of the magnetic flux lines represents the strength of the magnetic field.

Figure 5:
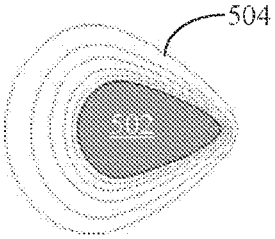
FIG. 5 illustrates another unshielded non-circular electrical conductor and magnetic flux, according to some embodiments.

FIG. 5 illustrates another unshielded non-circular electrical conductor 502 and magnetic flux 504, according to some embodiments. As explained above, the density of the magnetic flux lines represents the strength of the magnetic field. An electric current in the conductor creates the magnetic flux, which generally conforms to the shape of the conductor. Because of the non-circular shape of electrical conductor 502, flux 504 is asymmetric about the center point of the conductor, in contrast to the symmetry of flux that may occur if electrical conductor 502 were symmetric about a central point. Magnetic flux 504 has a counterclockwise orientation if the electric current in conductor 502 is directed out of the drawing, and the magnetic flux will have a clockwise orientation if the electric current in conductor 502 is directed into the drawing. The direction of a force on an electric or magnetic dipole, or paramagnetic or diamagnetic fluids, may depend on the orientation of the magnetic flux.

Figure 6:
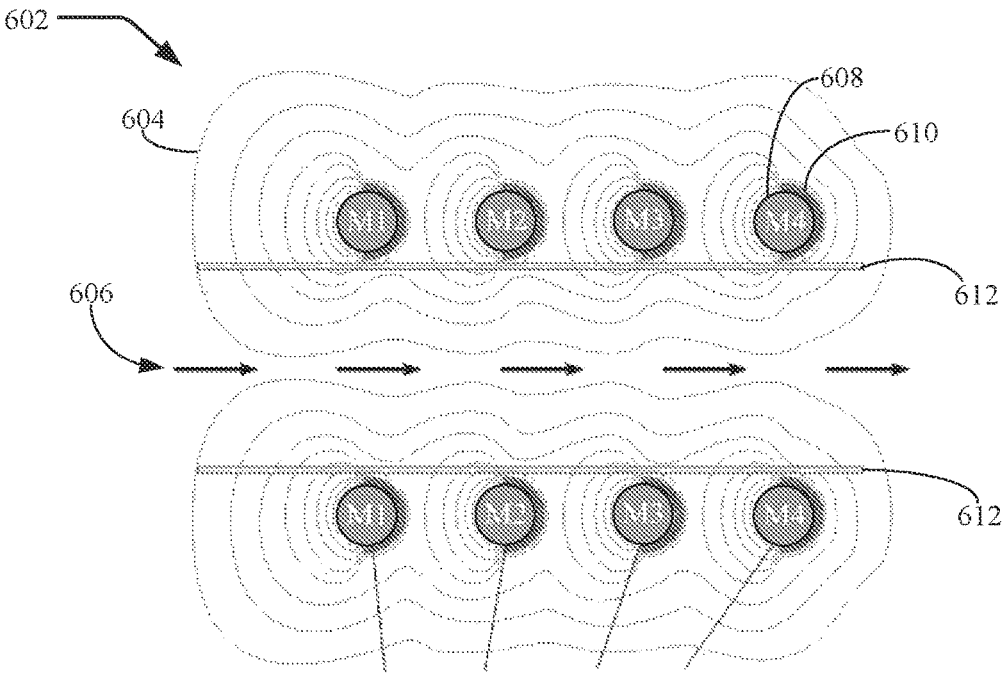
FIG. 6 is a schematic cross-section view of a two-phase magnetic fluid pump and magnetic flux, according to some embodiments.

FIG. 6 is a schematic cross-section view of a two-phase magnetic fluid pump 602 and magnetic flux 604, according to some embodiments. Pump 602, configured for conveying (e.g., pumping) a two-phase magnetic fluid 606, includes electromagnets 608 individually identified as M1-M4 for description purposes. Each electromagnet may be partially covered with shielding 610 to produce an asymmetric magnetic field, such as that illustrated in FIG. 2. In some embodiments, electromagnets 608 may be continuous in that each circumferentially traverses vessel 612. Thus, each electromagnet illustrated in the top "row" is respectively the same electromagnet (just a different cross-section thereof) as that of the bottom "row". Though four electromagnets 608 are illustrated, pump 602 may include many more. For example, pump 602 may be a portion of a larger pump or pump section. In other embodiments, instead of each electromagnet 608 circumferentially traversing vessel 612, the electromagnets may be discrete in that they comprise multiple individually-energizeable electromagnets positioned around the circumference of vessel 612. For example, each of M1-M4 in FIG. 6 may comprise several or more individual discrete electromagnets.

Vessel 612 may be a tube, pipe, or conduit for conveying the two-phase magnetic fluid. Two-phase magnetic fluid 606 may comprise a liquid phase and a gas phase. Pump 602 may include electronics (not illustrated) to, among other things, sequentially energize electromagnets 806. Such sequential energizing is described below. In the special example case of FIG. 6, all electromagnets 608 are activated (e.g., carrying electrical current) to illustrate flux 604 resulting from all the electromagnets at the same time. As described below, activation of the electromagnets may be performed in a sequence so that some of the electromagnets are activated while others are not.

Figure 7:
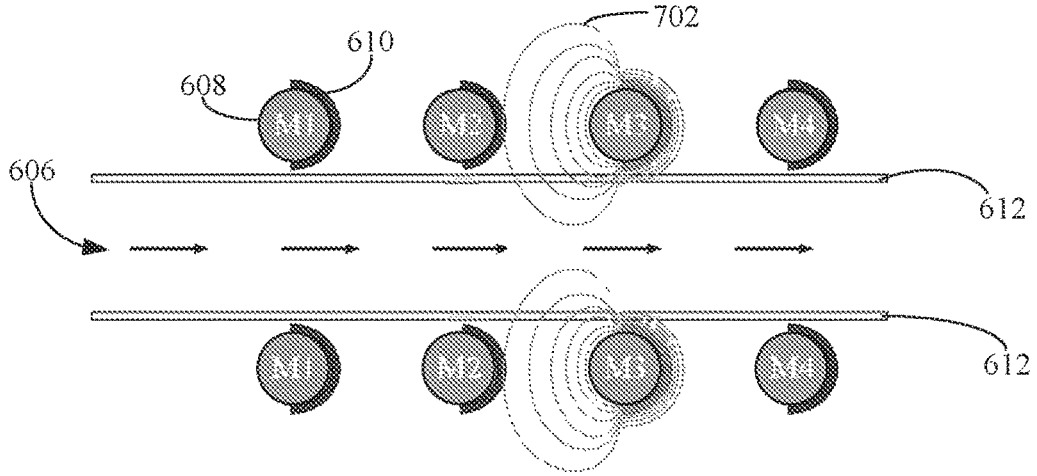
FIG. 7 is a schematic cross-section view of part of a sequence of energizing electromagnets of a two-phase magnetic fluid pump, according to some embodiments.

FIG. 7 is a schematic cross-section view of part of a sequence of energizing electromagnets 608 of two-phase magnetic fluid pump 602, according to some embodiments. Such a sequence of energizing the electromagnets is explained in detail below. FIG. 7 illustrates a part of the sequence wherein all electromagnets 608 are not activated except for M3, which produces flux 702. Just prior to this part of the sequence, only electromagnet M2 may have been activated, producing a flux similar in shape to flux 702 but located about M2 instead of M3. Just after the illustrated part of the sequence, only electromagnet M4 may be activated, producing a flux similar in shape to flux 702 but located about M4 instead of M3.

Figure 8:
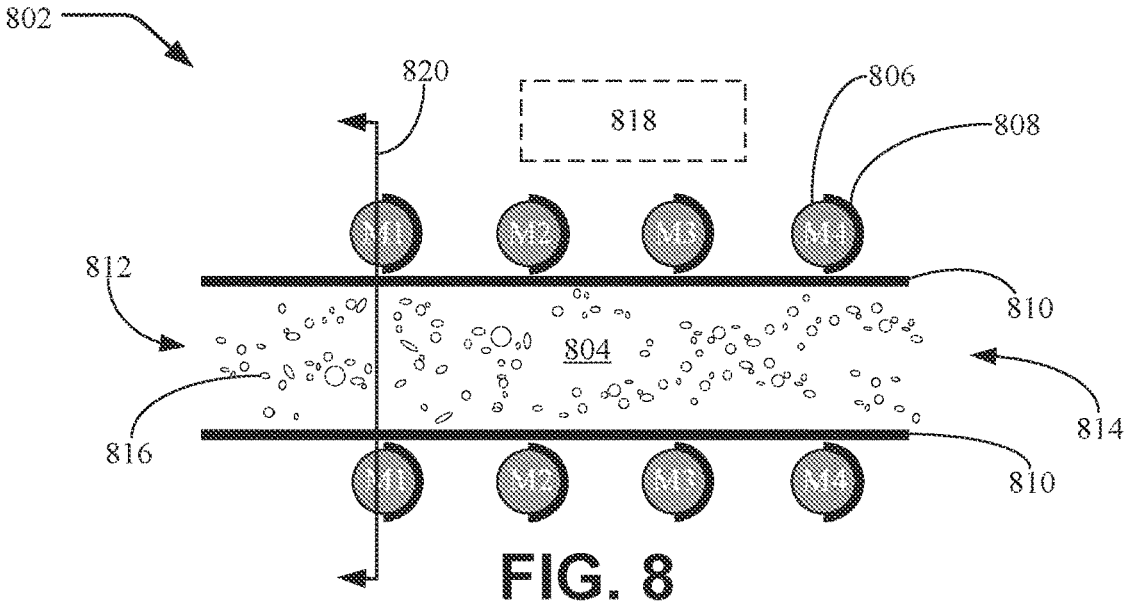
FIG. 8 is a schematic cross-section view of a two-phase magnetic fluid pump, according to some embodiments.

FIG. 8 is a schematic cross-section view of a two-phase magnetic fluid pump 802, according to some embodiments. Pump 802, configured for conveying (e.g., pumping) a two-phase magnetic fluid 804, includes electromagnets 806, individually identified as M1-M4 for description purposes. Each electromagnet may be partially covered with shielding 808 to produce an asymmetric magnetic field, such as that illustrated in FIG. 2. Electromagnets 806 each circumferentially traverse vessel 810. Thus, each electromagnet illustrated in the top "row" is respectively the same electromagnet (just a different cross-section thereof) as that of the bottom "row". Though four electromagnets 806 are illustrated, pump 802 may include many more. For example, pump 802 may be a portion of a larger pump or pump section. A benefit of having the electromagnetics not submerged in two-phase magnetic fluid 804 is that the electromagnets are protected from direct contact with the two-phase magnetic fluid, thus avoiding chemical compatibility issues as well as allowing for extra protections from electricity contacting the fluid, for example.

Electromagnets 806 may be superconducting electromagnets. For example, the electromagnets may comprise electrical conductors that behave as superconductors under particular (e.g., cold) thermal conditions. Vessel 810 may be a tube, pipe, or conduit for conveying the two-phase magnetic fluid. An input port 812 of vessel 810 may be where two-phase magnetic fluid 804 enters the vessel, and an output port 814 may be where the two-phase magnetic fluid exits the vessel. For example, the input port of the vessel may be the entrance of a pipe.

Two-phase magnetic fluid 804 may comprise a liquid phase and a gas phase, which is illustrated in FIG. 8 as numerous small bubbles 816. The quantity or density of such bubbles in the liquid phase may vary from time to time and from one location to another. Characteristics, such as shape and size of the bubbles may also vary. Generally, bubbles 816 may move in concert with the liquid phase of magnetic fluid 804. Some of the bubbles may, at least partially, be carried by momentum of the surrounding magnetic fluid. Paramagnetism of vapor (e.g., the bubbles), however, is weaker than paramagnetism of liquid, so the bubbles, and other manifestations of vapor in magnetic fluid 804, may likely not flow equally with the liquid phase flow. In various implementations, two-phase magnetic fluid 804 may comprise, instead of or in addition to bubbles, other two-phase flow regimes, such as stratified flow, annular flow, slug flow, and slug bubbly flow. Claimed subject matter is not limited to any particular type of flow for a two-phase magnetic fluid.

Pump 802 may include electronics 818 to, among other things, sequentially energize electromagnets 806. Such sequential energizing is described below. For example, electronics 818 may include circuitry that sequentially and cyclically applies a current first to electromagnet M1, subsequently to electromagnet M2, subsequently to electromagnet M3, and subsequently to electromagnet M4. Electronics 818 may include timing circuits to allow for particular time spans during which each of the electromagnets M1-M4 are energized and to allow for overlap or time gaps among the time spans, as described below. Such time spans, timing overlap, and time gaps may be adjustable. Electronics 818 may also be configured to apply voltage and current sufficient to de-activate the electromagnets which, if superconducting, may require energy to reduce their current carrying to zero.

Two-phase magnetic fluid pumps 802 may be arranged in various ways, according to some embodiments. For example, such pumps may be applied in numerous and varying types of applications, each calling for a value or range of flow volume for particular fluids and perhaps particular ratios of liquid to gas phases. To meet design specifications or requirements for various applications, multiple pumps 802 may be applied, in any quantity, in parallel and/or in series with one another.

Figure 9:
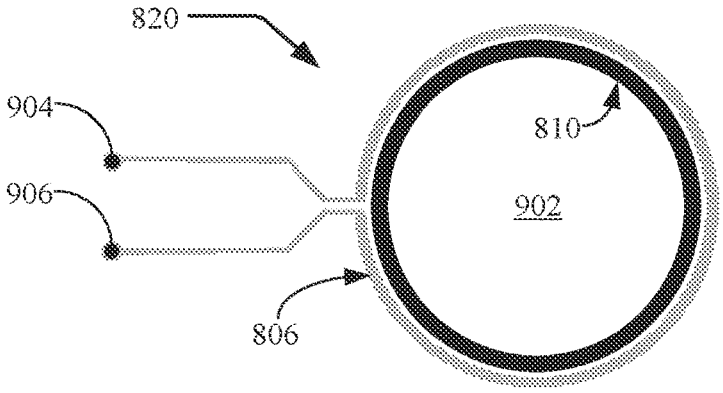
FIG. 9 is a cross-section view of a two-phase magnetic fluid pump, according to some embodiments.

FIG. 9 illustrates a cross-section view, identified as "820" in FIG. 8, of pump 802. Vessel 810 and (continuous, in contrast to discrete, as described above) electromagnet 806 (e.g., a portion of electromagnet M1) are not drawn to scale with respect to FIG. 8. Cross-section 820 illustrates electromagnet 806 traversing the circumference of vessel 810, which has an interior 902 to carry a two-phase magnetic fluid. Electrodes 904 and 906 schematically illustrate electrical connections to electromagnet 806 for a particular embodiment.

Figure 10:
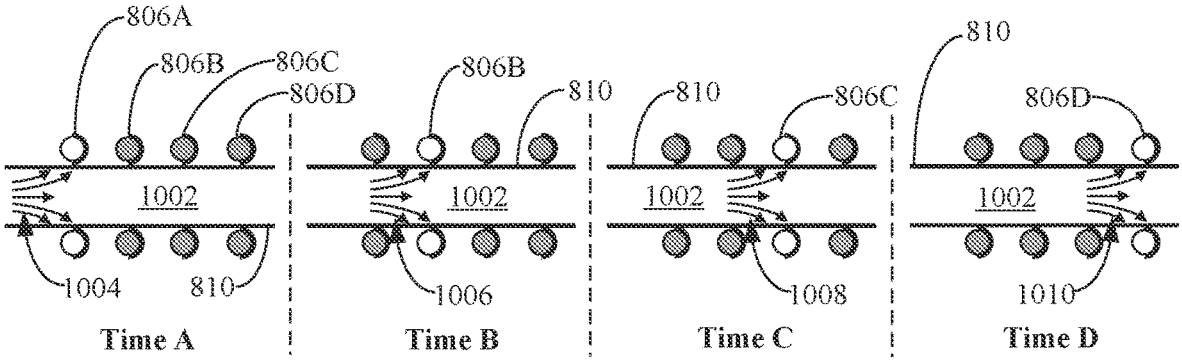
FIG. 10 is a schematic cross-section view of a sequence of energizing electromagnets of a two-phase magnetic fluid pump, according to some embodiments.

FIG. 10 illustrates schematic cross-section views of two-phase magnetic fluid pump 802 at different times during sequential energizing of a series of electromagnets 806, according to some embodiments. Each of electromagnets 806 are individually labelled 806A, 806B, 806C, and 806D. A conductor of an energized electromagnet carries an electric current, which comprises moving electric charges (e.g., electrons) that give rise to a magnetic field. If the conductor of an electromagnet is not carrying an electric current, e.g., is not energized, then the electromagnet will not give rise to a magnetic field (even though it is called an electromagnet, which is known as a magnet that can be turned on or off).

As noted in the description of FIG. 2, placing a shield at least partially on or near an electromagnet may distort its magnetic field, relative to the shape or distribution of the field without a shield nearby. Such distortion or reshaping may lead to an asymmetric magnetic field and regions (e.g., 208) that have a particularly strong magnetic field, which may act on the two-phase magnetic fluid. In general, the force density of the magnetic interaction between the fluid and the magnetic field is proportional to the magnetic susceptibility of the fluid multiplied by the gradient of the square of the magnitude of the magnetic field. A local force on the fluid is in the direction of intensifying magnetic field. In the case for liquid oxygen, the magnetic field acts on the paramagnetism of the oxygen (O2) molecule. The interaction between the time-varying magnetic fields of electromagnets 806 and the two-phase magnetic fluid, and how motion is imparted on the fluid for pumping, is now described.

At Time A, electronics 818 applies an electric current to electromagnet 806A to energize this electromagnet. As a result, electromagnet 806A produces a magnetic field. Simultaneously, electromagnets 806B, 806C, and 806D are not energized and thus do not produce a magnetic field. A magnetic fluid 1002, which may be in a liquid phase or a mixture of liquid and gas phases, is in vessel 810. The magnetic fluid may be liquid oxygen, for example. An interaction between the magnetic field of electromagnet 806A and the magnetic fluid is schematically illustrated by arrows 1004, which indicate a general direction of attraction and, thus, flow of magnetic fluid 1002. Gas phase (e.g., bubbles) dispersed in magnetic fluid 1002 may also flow with the (liquid phase of the) magnetic fluid. This example snapshot of time (Time A) demonstrates that magnetic fluid may be conveyed, in this example, toward the right of the figure by an applied magnetic field. A subsequent snapshot of time, however, would reveal that the magnetic fluid would soon cease to flow and instead "gather" near electromagnet 806A. To avoid this, and to convey magnetic fluid 1002 further to the right, electronics 818 deenergizes electromagnet 806A so the electromagnet no longer produces a magnetic field. For a conventional electromagnet, e.g., not a superconducting electromagnet, electronics 818 may deenergize the electromagnet by stopping the application of an electric current. For a superconducting electromagnet, however, the current may persist after power supplied by electronics 818 is removed. Accordingly, electronics 818 may provide a reverse voltage that is carefully adjusted to control the current in the electromagnet down to zero. In other implementations, electronics 818 may operate a relatively small heater that may be turned on to heat the electromagnet so as to cause the electromagnet to drop out of a superconductive state. Consequently, ceasing to apply power to the electromagnet may stop the current due to resistance.

Substantially while deenergizing electromagnet 806A, electronics 818 applies an electric current to electromagnet 806B to energize this electromagnet. As a result, only electromagnet 806B produces a magnetic field. In addition to 806A, electromagnets 806C and 806D are also not energized and thus do not produce a magnetic field. These conditions occur during Time B.

An interaction between the magnetic field of electromagnet 806B and the magnetic fluid is schematically illustrated by arrows 1006, which indicate a general direction of attraction and, thus, flow of magnetic fluid 1002. This example snapshot of time (Time B) demonstrates that magnetic fluid 1002 may be "pulled away" from the previous magnetic field of electromagnet 806A, which no longer exists, and pulled toward the magnetic field of electromagnet 806B. Thus, the magnetic fluid may be conveyed further toward the right of the figure by an applied magnetic field (of electromagnet 806B). As before, however, a subsequent snapshot of time would reveal that the magnetic fluid would soon cease to flow and instead "gather" near electromagnet 806B. To avoid this, and to again convey magnetic fluid 1002 further to the right, electronics 818 deenergizes electromagnet 806B so the electromagnet no longer produces a magnetic field. Some techniques for deenergizing an electromagnet are described above. Substantially while deenergizing electromagnet 806B, electronics 818 applies an electric current to electromagnet 806C to energize this electromagnet. As a result, only electromagnet 806C produces a magnetic field. In addition to 806B, electromagnets 806A and 806D are also not energized and thus do not produce a magnetic field. These conditions occur during Time C.

An interaction between the magnetic field of electromagnet 806C and the magnetic fluid is schematically illustrated by arrows 1008, which indicate a general direction of attraction and, thus, flow of magnetic fluid 1002. This example snapshot of time (Time C) demonstrates that magnetic fluid 1002 may be "pulled away" from the previous magnetic field of electromagnet 806B, which no longer exists, and pulled toward the magnetic field of electromagnet 806C. Thus, the magnetic fluid may be conveyed further toward the right of the figure by an applied magnetic field (of electromagnet 806C). As before, however, a subsequent snapshot of time would reveal that the magnetic fluid would soon cease to flow and instead "gather" near electromagnet 806C. To avoid this, and to once again convey magnetic fluid 1002 further to the right, electronics 818 deenergizes electromagnet 806C so the electromagnet no longer produces a magnetic field. Some techniques for deenergizing an electromagnet are described above. Substantially while deenergizing electromagnet 806C, electronics 818 applies an electric current to electromagnet 806D to energize this electromagnet. As a result, only electromagnet 806D produces a magnetic field. In addition to 806C, electromagnets 806A and 806B are also not energized and thus do not produce a magnetic field. These conditions occur during Time D.

An interaction between the magnetic field of electromagnet 806D and the magnetic fluid is schematically illustrated by arrows 1010, which indicate a general direction of attraction and, thus, flow of magnetic fluid 1002. This example snapshot of time (Time D) demonstrates that magnetic fluid 1002 may be "pulled away" from the previous magnetic field of electromagnet 806C, which no longer exists, and pulled toward the magnetic field of electromagnet 806D. Thus, the magnetic fluid may be conveyed further toward the right of the figure by an applied magnetic field (of electromagnet 806D). As before, however, a subsequent snapshot of time would reveal that the magnetic fluid would soon cease to flow and instead "gather" near electromagnet 806D. To avoid this, and to once again convey magnetic fluid 1002 further to the right, electronics 818 deenergizes electromagnet 806D while starting to apply an electric current to a subsequent electromagnet (not illustrated) in pump 802. The above-described cycle may continue for each of subsequent electromagnets in the pump.

In some embodiments, electronics 818 may apply an electric current to more than one electromagnet at any given time. In other words, multiple electromagnets of pump 802 may be simultaneously energized to produce their respective magnetic fields. A condition for such a presence of simultaneous magnetic fields, however, may be that each of these magnetic fields are spaced apart by distances that are large enough to avoid substantial overlap of the respective fields. This condition assures that each portion of magnetic fluid 1002 will not be attracted to the magnetic field of more than one electromagnet at a time. As illustrated in FIGS. 1 and 2, distances between magnetic flux lines 104 and 204 increase with increasing distance from electrical conductors 102 and 202 (e.g., the electromagnets). This illustrates that the strength of the magnetic field decreases with increasing distance from the electromagnets. Thus, for example, electronics 818 may energize both electromagnets 806A and 806D simultaneously if their respective magnetic fields don't substantially overlap. If they did overlap, then some portions of magnetic fluid 1002 may flow toward the left of the figure while other portions would flow toward the right. On the other hand, if there is no substantial overlap, then the magnetic fields of both electromagnets 806A and 806D may reinforce their "pumping" effect on the rightward flow of the magnetic fluid.

Figure 11:
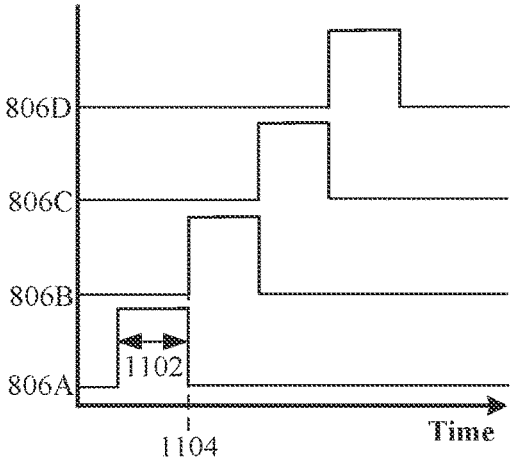
FIGS. 11-16 are timing diagrams for electric currents applied to electromagnets of a two-phase magnetic fluid pump, according to some embodiments.

FIG. 11 is a timing diagram for electric currents applied (e.g., by electronics 818) to electromagnets 806 of two-phase magnetic fluid pump 802, according to some embodiments. In this example, each of electromagnets 806 is momentarily energized by a square pulse having a duration 1102. In particular, electromagnet 806A is energized for a duration 1102 to produce a magnetic field. At time 1104, at the end of duration 1102, electrical current in electromagnet 806A stops flowing when electrical current in electromagnet 806B starts flowing. Similarly, electrical current in electromagnet 806B stops flowing when electrical current in electromagnet 806C starts flowing, and electrical current in electromagnet 806C stops flowing when electrical current in electromagnet 806D starts flowing. Thus, occurrence of magnetic fields of the respective electromagnets do not overlap and only one of the electromagnets is producing a magnetic field at any given time. In some implementations, electronics 818 may allow for adjustments of duration 1102 so as to "optimize" or change the performance of pump 802. Also, electronics 818 may be configured to vary the frequency or time period that electromagnets 806 are sequentially energized based, at least in part, on flow speed of the two-phase magnetic fluid in pump 802. In another example, electronics 818 may be configured to reverse the sequence (e.g., from A, B, C, D . . . to . . . D, C, B, A) of energizing electromagnets 806 to stop or reverse direction of flow of the two-phase magnetic fluid.

Figure 12:
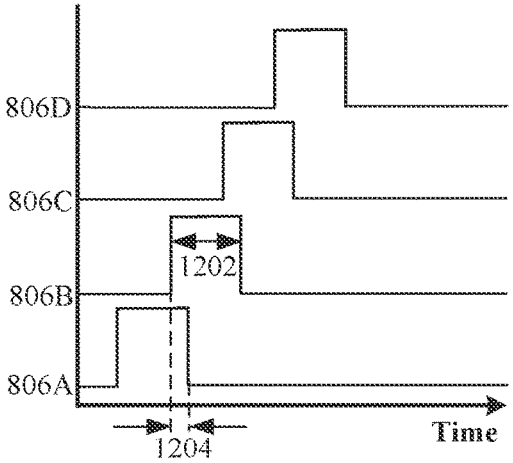

FIG. 12 is a timing diagram for electric currents applied to electromagnets 806 of two-phase magnetic fluid pump 802, according to other embodiments. In this example, each of electromagnets 806 is momentarily energized by a square pulse having a duration 1202. In particular, electromagnet 806A is energized for a duration 1202 to produce a magnetic field. There is a time overlap of duration 1204 during which electrical current flows in both electromagnets 806A and 806B. Similarly, such a time overlap of duration 704 also occurs during which electrical current flows in both electromagnets 806B and 806C, and a time overlap of duration 704 occurs during which electrical current flows in both electromagnets 806C and 806D. Thus, occurrence of magnetic fields of two adjacent electromagnets overlap and these two electromagnets produce their respective magnetic fields during this time overlap. In some implementations, electronics 818 may allow for adjustments of each of duration 702 and 704 so as to "optimize" or change the performance of pump 802.

Figure 13:
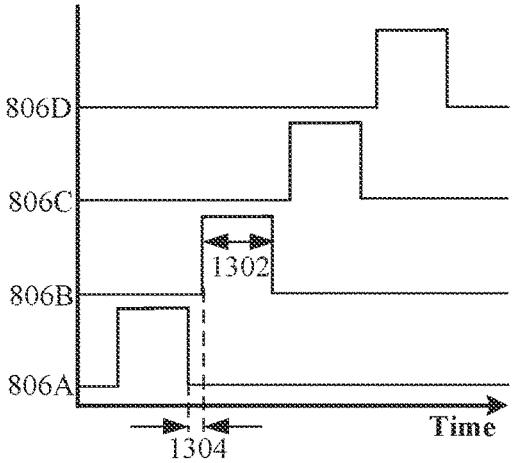

FIG. 13 is a timing diagram for electric currents applied to electromagnets 806 of two-phase magnetic fluid pump 802, according to still other embodiments. In this example, each of electromagnets 806 is momentarily energized by a square pulse having a duration 1302. In particular, electromagnet 806A is energized for a duration 1302 to produce a magnetic field. There is a time delay of duration 1304 between when electrical current stops flowing in electromagnets 806A and when electrical current starts flowing in electromagnet 806B. Similarly, such a time delay of duration 1304 also occurs between energizing of electromagnets 806B and 806C, and between electromagnets 806C and 806D. During these delays, no current flows and no magnetic field is present. (Herein, it is to be understood that "no current flows" may include a situation wherein a trivially small amount of current may flow but is a small enough flow of current so as to result in less than a weak or negligible magnetic field.) In some implementations, electronics 818 may allow for adjustments of each of duration 1302 and delay 1304 so as to "optimize" or change the performance of pump 802.

Figure 14:
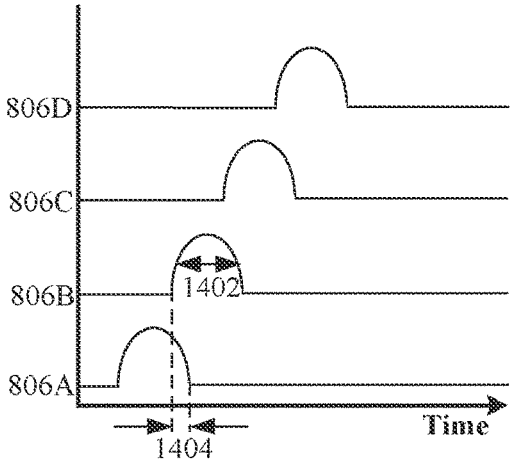

FIG. 14 is a timing diagram for electric currents applied to electromagnets 806 of two-phase magnetic fluid pump 802, according to still other embodiments. In this example, each of electromagnets 806 is momentarily energized by a time-varying (e.g., non-square) pulse having a duration (e.g., FWHM, full width at half max) 1402. In other examples, in place of the pulse shape illustrated in FIG. 14, such a time-varying pulse may be sinusoidal, saw-tooth, ramp, exponential decay/increase, as well as numerous other waveform shapes, which may be tuned to "optimize" or change the performance of pump 802. In particular, electromagnet 806A is energized for a duration 1402 to produce a magnetic field. There is a time overlap of duration 1404 during which electrical current flows in both electromagnets 806A and 806B. Similarly, such a time overlap of duration 1404 also occurs during which electrical current flows in both electromagnets 806B and 806C, and a time overlap of duration 704 occurs during which electrical current flows in both electromagnets 806C and 806D. Thus, occurrence of magnetic fields of two adjacent electromagnets overlap and these two electromagnets produce their respective magnetic fields during this time overlap. In some implementations, electronics 818 may allow for adjustments of each of duration 1402 and 1404 so as to "optimize" or change the performance of pump 802. In some embodiments, any combination of conditions or parameters of energizing waves forms illustrated in FIGS. 11-14 may be used to operate pump 802, and claimed subject matter is not limited to any particular energizing scheme.

Figure 15:
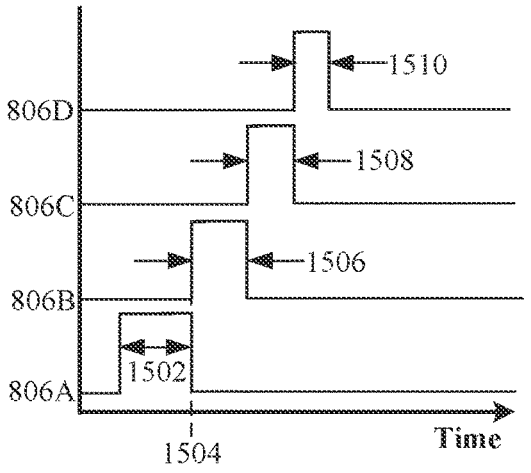

FIG. 15 is a timing diagram for electric currents applied (e.g., by electronics 818) to electromagnets 806 of two-phase magnetic fluid pump 802, according to some embodiments. In this example, each of electromagnets 806 is momentarily energized by a square pulse having consecutively diminishing durations. In particular, electromagnet 806A is energized for a duration 1502 to produce a magnetic field. At time 1504, at the end of duration 1502, electrical current in electromagnet 806A stops flowing when electrical current in electromagnet 806B starts flowing for a duration 1506, which is less than duration 1502. Electrical current in electromagnet 806B stops flowing when electrical current in electromagnet 806C starts flowing for a duration 1508, which is less than duration 1506, and electrical current in electromagnet 806C stops flowing when electrical current in electromagnet 806D starts flowing for a duration 1510, which is less than duration 1508. Thus, occurrence of magnetic fields of the respective electromagnets do not overlap and only one of the electromagnets is producing a magnetic field at any given time. In some implementations, electronics 818 may allow for adjustments of durations 1502, 1506, 1508, and 1510 so as to "optimize" or change the performance of pump 802. Also, electronics 818 may be configured to vary the frequency or time period that electromagnets 806 are sequentially energized based, at least in part, on flow speed of the two-phase magnetic fluid in pump 802. In another example, electronics 818 may be configured to reverse the sequence (e.g., from A, B, C, D . . . to . . . D, C, B, A) of energizing electromagnets 806 to stop or reverse direction of flow of the two-phase magnetic fluid.

Figure 16:
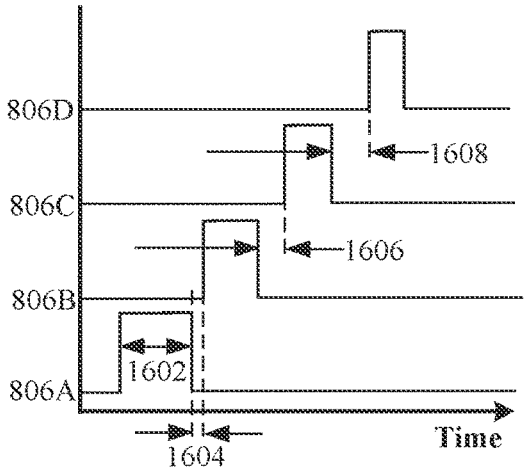

FIG. 16 is a timing diagram for electric currents applied to electromagnets 806 of two-phase magnetic fluid pump 802, according to still other embodiments. In this example, each of electromagnets 806 is momentarily energized by a square pulse having consecutively diminishing durations, similar to that illustrated in FIG. 15. For example, electromagnet 806A is energized for a duration 1602 to produce a magnetic field. Subsequent electromagnetics may be energized with shorter pulse durations. In contrast to the pulse sequence illustrated in FIG. 15, there is a time delay of duration 1604 between when electrical current stops flowing in electromagnet 806A and when electrical current starts flowing in electromagnet 806B. Similarly, a time delay of duration 1606, which may be less than duration 1604, also occurs between energizing of electromagnets 806B and 806C. A time delay of duration 1608, which may be less than duration 1606, also occurs between electromagnets 806C and 806D. During these delays, no current (or very small current) flows and substantially no magnetic field is present. In some implementations, electronics 818 may allow for adjustments of each of delays 1604, 1606, and 1608 and duration 1602 so as to "optimize" or change the performance of pump 802

Figure 17:
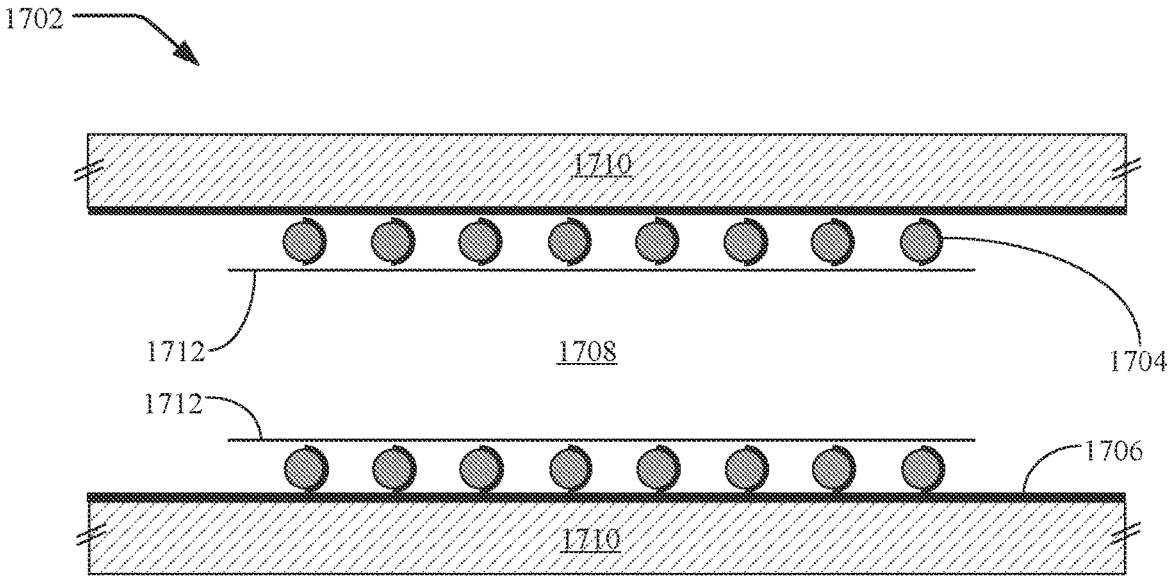
FIG. 17 is a schematic cross-section view of a two-phase magnetic fluid pump that includes electromagnets positioned to be immersed in the flow of a two-phase magnetic fluid, according to some embodiments.

FIG. 17 is a schematic cross-section view of a two-phase magnetic fluid pump 1702 that includes electromagnets 1704 inside vessel 1706 (e.g., pipe) so as to be immersed in the flow of a two-phase magnetic fluid 1708, according to some embodiments. Electromagnets, 1704 may be continuous or discrete, as described above. By being immersed, electromagnets 1704 are subjected to cryogenic temperatures of the two-phase magnetic fluid. The cold cryogenic fluid in the vessel may efficiently cool electromagnets 1704 to a temperature cold enough to where conductors of the electromagnets can behave as superconductors, or at least to where resistance of the conductors is relatively low. Another benefit that may arise by locating electromagnets 1704 inside vessel 1706 is that magnetic flux created by the electromagnets is not diminished inside the vessel because the flux need not cross through the wall of the vessel. Thus, two-phase magnetic fluid 1708 may be subjected to magnetic forces greater than if the electromagnets were located outside the vessel. In some implementations, thermal insulation 1710 may be located to surround vessel 1706, helping to maintain the electromagnets and the two-phase magnetic fluid at a substantially cold temperature by resisting heat flow from the outside environment.

In some embodiments, electromagnets 1704 may have a shape that reduces resistance to flow of two-phase magnetic fluid 1708. For example, electromagnets 1704 may comprise flat conductors, such as those illustrated in FIGS. 3 and 4. In various embodiments, a relatively thin membrane 1712, which does not substantially affect magnetic flux and does not resist thermal transmission, may cover electromagnets 1704 to create a relatively smooth surface for fluid flow. The two-phase magnetic fluid may be on both sides of membrane 1712 so electromagnets 1704 remain immersed in the fluid.

Figure 18:
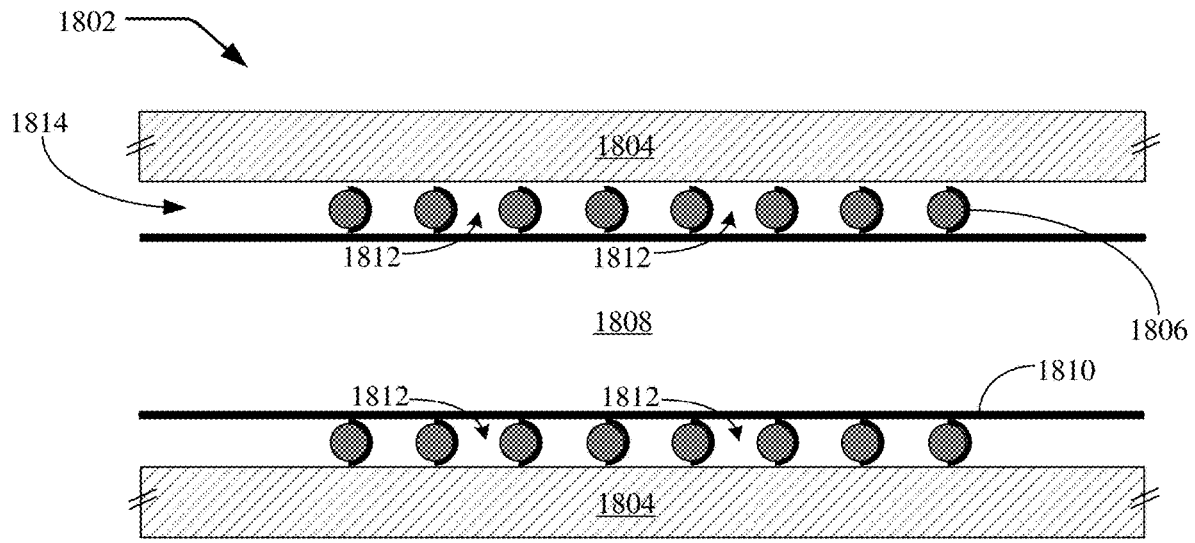
FIG. 18 is a schematic cross-section view of a two-phase magnetic fluid pump that includes thermal insulation, according to some embodiments.

FIG. 18 is a schematic cross-section view of a two-phase magnetic fluid pump 1802 that includes thermal insulation 1804, according to some embodiments. Electromagnets 1806, which may be continuous or discrete, as described above, may be located where they are subjected to cryogenic temperatures of the two-phase magnetic fluid 1808 flowing in vessel 1810 (e.g., pipe). For example, thermal conductivity of the wall of the vessel may allow for "coldness" of a cryogenic fluid in the vessel to transfer to electromagnets 1806 and cool them to a temperature cold enough to where conductors of the electromagnets can behave as superconductors, or at least to where resistance of the conductors is relatively low. Accordingly, electromagnets 1806 may be configured and/or positioned to be cooled by the two-phase magnetic fluid, as indicated by arrows 1812. Electromagnets 1806 may be located between the wall of vessel 1810 and thermal insulation 1804 in a space 1814. The thermal insulation may allow the electromagnets in space 1814 to maintain a substantially cold temperature by resisting heat flow from the outside environment to space 1814. A benefit of having the electromagnetics not submerged in the two-phase magnetic fluid is that the electromagnets are protected from direct contact with the two-phase magnetic fluid, thus avoiding chemical compatibility issues as well as allowing for extra protections from electricity contacting the fluid.

Figure 19:
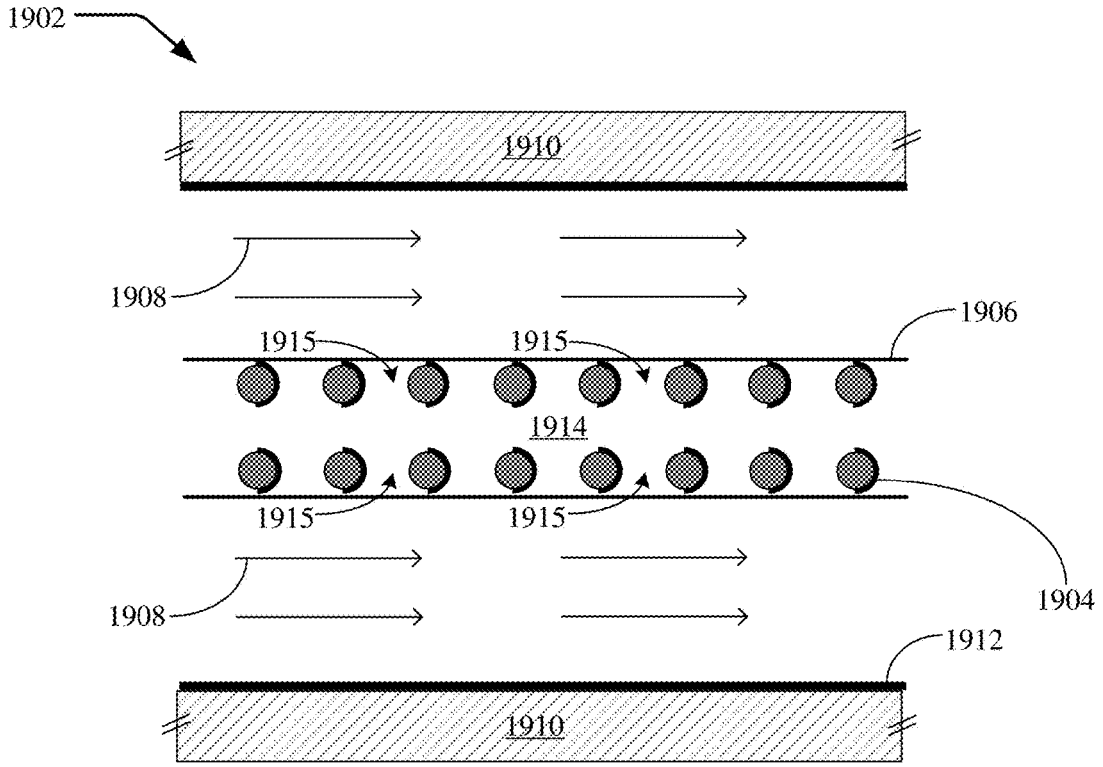
FIG. 19 is a schematic cross-section view of a two-phase magnetic fluid pump that includes electromagnets in a vessel that is positioned to be immersed in the flow of a two-phase magnetic fluid, according to some embodiments.

FIG. 19 is a schematic cross-section view of a two-phase magnetic fluid pump 1902 that includes electromagnets 1904, which may be continuous or discrete, as described above, in an interior vessel 1906 that is positioned to be immersed in the flow of a two-phase magnetic fluid 1908, according to some embodiments. Accordingly, two-phase magnetic fluid 1908 flows concentrically on the outside of interior vessel 1906, which may be cylindrical. By being immersed, electromagnets 1904 are subjected to cryogenic temperatures of the two-phase magnetic fluid. The cold cryogenic fluid in the vessel may efficiently cool electromagnets 1904 to a temperature cold enough to where conductors of the electromagnets can behave as superconductors, or at least to where resistance of the conductors is relatively low. In some implementations, thermal insulation 1910 may be located on outer vessel 1912, which contains the two-phase magnetic fluid and the electromagnets in interior vessel 1906. Thermal insulation 1910 may help to maintain the two-phase magnetic fluid at a substantially cold temperature by resisting heat flow from the outside environment. In some implementations, a volume 1914 inside interior vessel 1906, where electromagnets 1904 are located, may be open at one or more locations 1915 (illustrated by arrows) to the portion of the volume inside outer vessel 1912 that contains two-phase magnetic fluid 1908. Such openings may allow the two-phase magnetic fluid to enter into volume 1914.

The embodiment illustrated in FIG. 19 provides a number of benefits. For example, currents of two-phase magnetic fluid 1908 may be magnetically pulled away from the wall of outer vessel 1912 (e.g., instead of toward the wall of vessel 1810), which may reduce heat transfer from outside the outer vessel to the two-phase magnetic fluid. Another benefit is that two-phase magnetic fluid pump 1902 may be easier to insulate as compared to insulating two-phase magnetic fluid pump 1802. Yet another benefit is that the configuration of two-phase magnetic fluid pump 1902 may allow for the electromagnets portion to be an insertable module instead of having to build such a portion (e.g., 1806) around a pipe (e.g., 1810), for example.

In some embodiments, one end of interior vessel 1906 may terminate at some point (not illustrated) along the length of outer vessel 1912. The other end of interior vessel 1906 may terminate outside outer vessel 1912 beyond a turned or curved section, such as an elbow, corner, or Tee of outer vessel 1912. Such a turned or curved section may be a convenient portion along the length of outer vessel 1912 for interior vessel 1906, and the electromagnets and electrical conductors contained therein, to exit the outer vessel so that the electrical conductors can be connected to a power supply, for example.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific embodiments or examples are presented by way of examples for purposes of illustration and description. They are not intended to be exhaustive of or to limit this disclosure to the precise forms described. Many modifications and variations are possible in view of the above teachings. The embodiments or examples are shown and described in order to best explain the principles of this disclosure and practical applications, to thereby enable others skilled in the art to best utilize this disclosure and various embodiments or examples with various modifications as are suited to the particular use contemplated. It is intended that the scope of this disclosure be defined by the following claims and their equivalents.

We claim as follows:

1. A pump for conveying a two-phase magnetic fluid, the pump comprising:

a vessel for conveying the two-phase magnetic fluid, the vessel including an input port and an output port for the two-phase magnetic fluid;

a first electromagnet and a second electromagnet, the first electromagnet located closer than the second electromagnet to the input port, and the second electromagnet located closer than the first electromagnet to the output port, wherein at least one of the first electromagnet and the second electromagnet comprises a shield configured to reshape the magnetic field of the electromagnet so as to create an asymmetric magnetic flux distribution across the vessel; and electronics to energize the first electromagnet and the second electromagnet sequentially such that i) the energized first electromagnet applies a force on the two-phase magnetic fluid to convey the two-phase magnetic fluid from the input port of the vessel and toward the first electromagnet, and ii) the energized second electromagnet applies a force on the two-phase magnetic fluid to convey the two-phase magnetic fluid away from the first electromagnet and toward the output port of the vessel.

2. The pump of claim 1, wherein the first electromagnet and the second electromagnet are located outside of the vessel and along a perimeter of the vessel.

3. The pump of claim 1, wherein the first electromagnet and the second electromagnet are located to be subjected to cryogenic temperatures of the two-phase magnetic fluid via a wall of the vessel.

4. The pump of claim 1, wherein the first electromagnet and the second electromagnet comprise superconducting conductors.

5. The pump of claim 4, wherein the superconducting conductors of the first electromagnet and the second electromagnet are located inside of the vessel and configured to be at least partially immersed and cooled by the two-phase magnetic fluid.

6. A pump for conveying a two-phase magnetic fluid, the pump comprising:

a vessel for conveying the two-phase magnetic fluid, the vessel including an input port and an output port for the two-phase magnetic fluid;

a first electromagnet and a second electromagnet, the first electromagnet located closer than the second electromagnet to the input port, and the second electromagnet located closer than the first electromagnet to the output port; and electronics to energize the first electromagnet and the second electromagnet sequentially such that i) the energized first electromagnet applies a force on the two-phase magnetic fluid to convey the two-phase magnetic fluid from the input port of the vessel and toward the first electromagnet, and ii) the energized second electromagnet applies a force on the two-phase magnetic fluid to convey the two-phase magnetic fluid away from the first electromagnet and toward the output port of the vessel, wherein the first electromagnet and the second electromagnet comprise shielding to at least partially block magnetic flux produced by the first electromagnet and the second electromagnet on the output port side of the first electromagnet and the second electromagnet, respectively.

7. The pump of claim 4, wherein the magnetic flux of the first electromagnet and the second electromagnet penetrate the vessel.

8. The pump of claim 1, wherein the electronics are configured to vary how long the first electromagnet and the second electromagnet are energized based, at least in part, on flow speed of the two-phase magnetic fluid.

9. The pump of claim 1, wherein the electronics are configured to reverse the sequence of energizing the first electromagnet and the second electromagnet to stop or reverse direction of flow of the two-phase magnetic fluid.

10. The pump of claim 1, wherein the two-phase magnetic fluid includes a gas phase and a liquid phase.

11. The pump of claim 1, wherein the two-phase magnetic fluid comprises liquid oxygen.

12. The pump of claim 1, further comprising one or more sensors to measure speed or volume of flow of the two-phase magnetic fluid.

13. A pump for conveying a two-phase magnetic fluid, the pump comprising:

a vessel for conveying the two-phase magnetic fluid, the vessel including an input port and an output port for flow of the two-phase magnetic fluid, the two-phase magnetic fluid comprising a cryogenic two-phase magnetic fluid superconducting electromagnets configured to be sequentially energized to produce an asymmetric magnetic field in the two-phase magnetic fluid to create a force imbalance on the two-phase magnetic fluid that imparts movement of the two-phase magnetic fluid in a general direction from the input port to the output port, wherein the superconducting electromagnets are located in a region thermally shared with the two-phase magnetic fluid and bounded by thermal insulation, such that the superconducting electromagnets are cooled by the cryogenic two-phase magnetic fluid while being isolated from direct contact with the fluid; and electronics to sequentially energize the superconducting electromagnets.

14. The pump of claim 13, wherein the superconducting electromagnets are positioned between a wall of the vessel and the thermal insulation such that they are cooled by conduction through the wall of the vessel.

15. The pump of claim 13, wherein the superconducting electromagnets are positioned in an interior vessel concentric with the vessel and isolated from the two-phase magnetic fluid by a membrane, the interior vessel being thermally shared with the two-phase magnetic fluid.

16. The pump of claim 13, wherein the electronics are configured to vary frequency or time period that the superconducting electromagnets are sequentially energized based, at least in part, on flow speed of the two-phase magnetic fluid.

17. The pump of claim 13, wherein the electronics are configured to reverse the sequence of energizing the superconducting electromagnets to stop or reverse direction of flow of the two-phase magnetic fluid.

18. The pump of claim 13, wherein the two-phase magnetic fluid includes a gas phase and a liquid phase.

19. The pump of claim 13, wherein the two-phase magnetic fluid comprises liquid oxygen.

20. The pump of claim 13, wherein the two-phase magnetic fluid comprises a ferromagnetic, paramagnetic, or diamagnetic fluid.

* * * * *